United States Patent [19]

Jansson

[11] Patent Number: 4,753,558

[45] Date of Patent: Jun. 28, 1988

[54] INSTALLATION DRILL

[76] Inventor: Lars O. Jansson, Eriksberg, S-740 47 Harbonäs, Sweden

[21] Appl. No.: 763,232

[22] Filed: Aug. 7, 1985

[30] Foreign Application Priority Data

Aug. 8, 1984 [SE] Sweden ..... 8404027

[51] Int. Cl.[4] ..... B27G 15/00

[52] U.S. Cl. ..... 408/212; 144/219; 407/54; 408/225

[58] Field of Search ..... 408/211, 212, 230, 223, 408/224, 225; 407/53, 54; 144/219

[56] References Cited

U.S. PATENT DOCUMENTS 949,126 2/1910 Lyons ..... 144/219
1,385,750 7/1921 Pollock ..... 407/54
1,446,194 2/1923 McCullough ..... 144/219
1,461,376 7/1923 Bartlett ..... 144/219
3,920,350 11/1975 Southall ..... 408/211

FOREIGN PATENT DOCUMENTS 485867 12/1927 Fed. Rep. of Germany ..... 407/53
487142 8/1928 Fed. Rep. of Germany ..... 407/53

*Primary Examiner*—Z. R. Bilinsky
*Attorney, Agent, or Firm*—Witherspoon & Hargest

[57] ABSTRACT

The present invention concerns in brief a drill (1) for making of preferably through installation bores, through which bores flexible shafts, cables and the like can be lead in. The drill (1) comprises a bore crown (2) and a shank (3). The bore crown (2) has main cutting edges (6, 7) for forward drilling, side cutting edges (8) for radial drilling, and end cutting edges (9) for rearward drilling. The shank (3) preferably has a significantly smaller thickness than the area being drilled by the main cutting edges (6, 7).

3 Claims, 4 Drawing Sheets

INSTALLATION DRILL

The present invention relates to drills, in particular to an installation drill, which primarely permits drilling in an arc through a wooden piece or other relatively soft material. However, by special treatment of the cutting edges, also relatively hard materials may be cut by the drill.

The drill according to this invention is in the first place intended for drilling the curved bore through a window casement, through which the flexible shaft for the manoeuvring of a Venetian blind should be extended. It is to realized, however, that the drill according to the present invention can be used for many different types of installations, such as with electrical cables, hoses and the like.

The manoeuvre of Venetian blinds is done by the means of a flexible shaft, which in most cases extends from a mounting on the side of the window casement, that is turned toward the room, and to a longitudinal shaft, which is parallel to the window glass and which, thus, extends at a right angle to the direction of entry of the flexible shaft into the window casement. The bore through the window casement is normally drilled by the means of a twist drill with one bore from the outside of the casement and with another one from the inside of the casement. These two bores thus constitute the through bore, through which the flexible shaft can be lead in.

The problems incurring by this method are partly that a sharp angle is developed in the through bore, where the two bores meet, and partly that the entrance and exit openings get too big from the attempts, during drilling, to move the drill sideways so as to make the angle between the two bores less pronounced.

The usually occuring sharp angle makes the flexible shaft exposed to a bending effect during the turning, and this combined movement easily exhausts the material in the flexible shaft, which breaks or at any rate gets shivered in both cases making the manoeuvre of the Venetian blind impossible. Too large entrance and exit bores make the mounting ugly, since they require large escutcheon plates or other measures to be taken to make the bores inconspicuous.

It is an object of the present invention to remove the above problems. This object is attained by a drill of the kind defined in the claims, where it will also demonstrate what in particular is characteristic of the invention.

Figure 1:
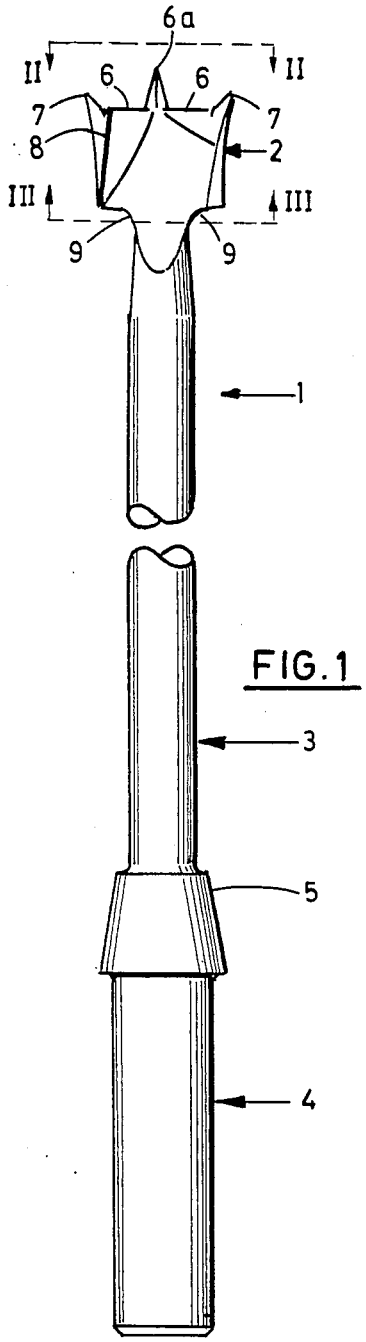
Figure 2:
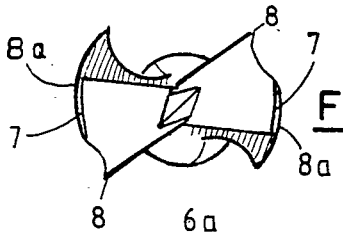
Figure 3:
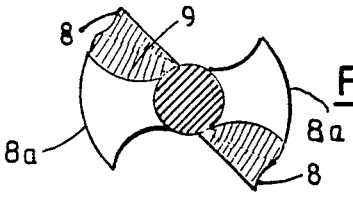
Figure 4:
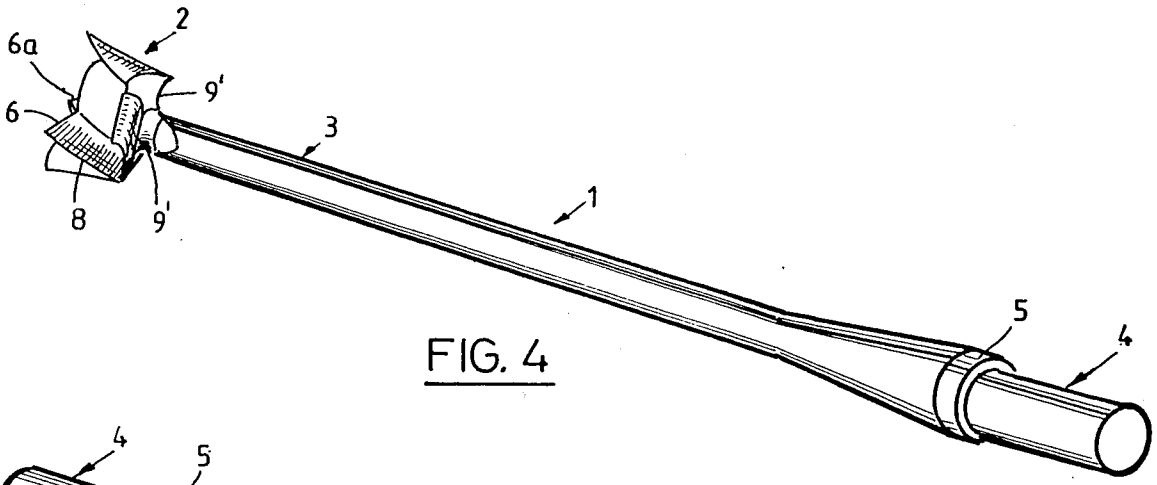
Figure 5:
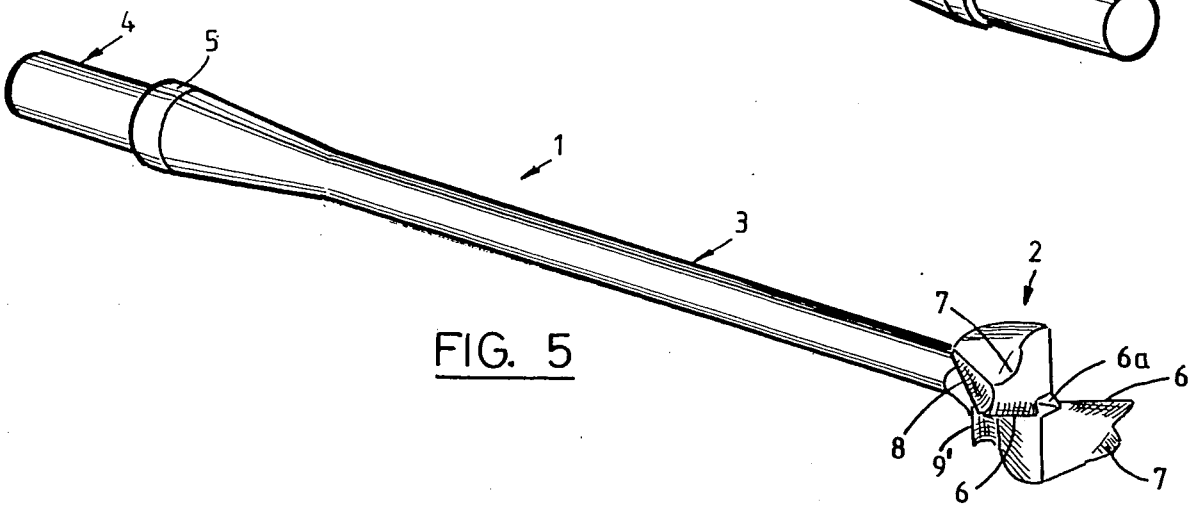
Figure 6:
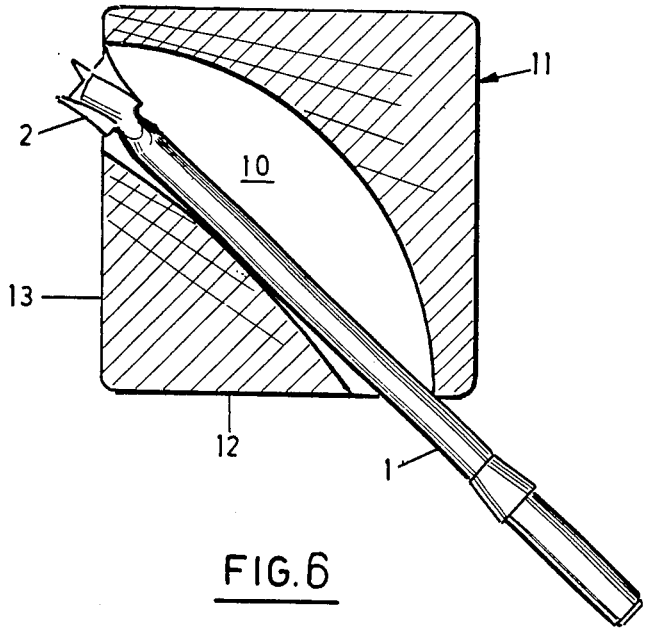
Figure 7:
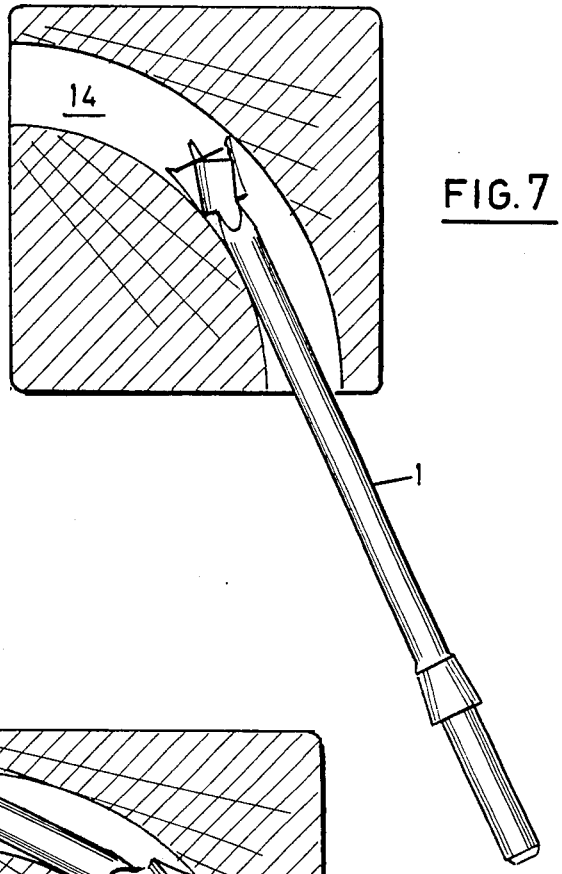
Figure 8:
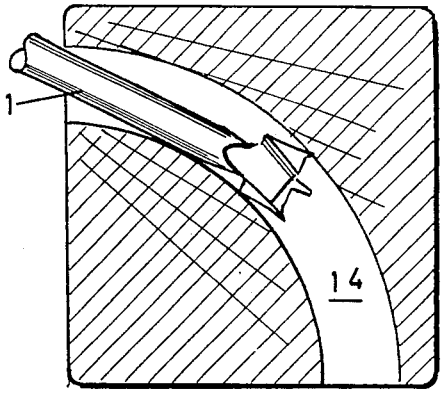

The invention will be described more in detail in the following with reference to the accompanying drawings, in which:

FIG. 1 is a partially cutaway side view of an embodiment of a drill according to this invention, FIG. 2 is an end view taken along the lines II—II of FIG. 1, FIG. 3 is a section taken along the lines III—III of FIG. 1, FIGS. 4 and 5 are perspective views of a second embodiment of the drill according to this invention, FIG. 6 is a section through a window casement showing the drill of FIG. 1 during drilling of a curved installation bore, FIGS. 7 and 8 are sections as shown in FIG. 6 but illustrating the drilling of a curved installation bore, where the drilling is being done from both sides of the bore.

The drill 1 shown in FIGS. 1-5 comprises a drill shank 3, having at one end an attachment portion 4 for a boring machine or similar and at the other end a bore crown 2. The attachment portion is spaced apart from the actual shank 3 by a collar 5. The shank 3 is significantly thinner than the diameter of the bore, which is cut by the bore crown 2.

The bore crown 2 has basically essentially conventionally designed, forward in the direction of the drilling, cutting edges 6 extended from the centre pin 6*a* to the outer edge of the bore crown 2. Two roughing edges 7 located diametrically opposite to each other cutting the circle of the bore are placed somewhat after the outer ends of the cutting edges 6 as seen in the direction of rotation of the drill 1 but somewhat ahead two side cutting edges 8 arranged opposite to each other on the outer periphery of the bore crown 2. The side cutting edges 8 constitute a continuation of the cutting edges 6.

In the direction of rotation after respective side cutting edge 8 there is a support surface 8*a* which is located radially slightly inside the side cutting edge 8. These support surfaces 8*a* determined the cutting depth of the side cutting edges 8.

The side cutting edges 8 make it possible to cut in the radial direction and due to the support from the support surfaces 8*a* this cutting in the radial direction takes place very smoothly although the form and direction of the cutting edges 8 are not critical.

The embodiment of the drill shown in FIGS. 1 to 3, the bore crown 2 comprises also a couple of cutting edges 9 on the part of the bore crown 2 which is turned backwards, i.e. towards the actual shank 3. The back cutting edges 9 are extended between the shank 3 and the periphery of the crown. In the embodiment shown in FIGS. 4 and 5 the back cutting edges are extended from the upper corners of the side cutting edges 8 and inwards and also across the shank 3. The latter embodiment has shown to be very effective for drilling in all directions and especially backwards.

When making a through installation bore 10 in accordance with FIG. 6 that extends at an angle between two adjacent walls of a schematically shown window casement 11, this takes place so that the drill 1 is moved perpendicular to the entrance wall 12, and there the drill works its way inwards a length that corresponds more than enough to the length of the bore head 2. Thereafter, the bore 1 is tilted in the direction of the intended exit opening in the second wall 13, whereby the side edges 8 will allow this machining. The drill is then moved backwards a distance, letting the rearwardly directed edges 9 cut against the inner wall. By moving the drill 1 forward and back it will make a through bore 10, which is expanded just inside the entrance and exit openings. These openings will be of a size, which is not significantly larger than the normal cutting diameter of the drill 1. By letting the drill 1 work against the walls of the bore 10, the rounded form shown in FIG. 6 will readily be obtained. Thus, those angles or corners are missing, which otherwise are present causing damages on the flexible shaft which is to extend through the bore 10. Contributing to the great functionability is also the fact, that the bore crown 2 is significantly bigger or has a significantly larger bore cut area than the shank 3 is thick.

In FIGS. 7 and 8 there is illustrated how a curved elongated bore 14 can be made by the means of a drill according to this invention without the bore receiving any significant increase in its diameter, not even inside the entrance and exit bores. Making of such bores takes place from both ends of the intended bore 14, the shank 3, thin in comparison to the boring head 2, permitting the drill 1 to work its way through the desired curvature, at the same time as the side cutters 8 are machining the walls of the bore 14.

One realizes that the drill 1 according to this invention in spite of its extreme simplicity more or less has revolutionized the installation work, in particular concerning mounting of between-panes Venetian blinds. A person skilled in the art can easily from what is taught therein modify the drill for various applications, but such modifications are intended to lie within the scope of this invention as it has been defined in the appended claims.

I claim:

1. An installation drill for making bores including curved through-bores for the lead-in of flexible shafts, cables and the like, comprising a bore crown having a longitudinal axis, a shank extending from said bore crown along said longitudinal axis, the diameter of said shank being substantially less than the surface cut by the bore crown, said bore crown having a first region located away from said shank, an opposite second region adjacent said shank, and a side region extending in a general axial direction between said first and second regions, said first region including means for cutting said bore in a first axial direction including a centering pin (6*a*) comprising at least one surface extending in the direction of said longitudinal axis from a base to a leading point, a plurality of forward cutting edges (6), extending radially relative to said longitudinal axis, each of which includes a first end which intersects with said base of said centering pin and an opposite second end spaced from said longitudinal axis, and a plurality of roughing edges (7) each of which is adjacent to a respective second end of a corresponding cutting edge (6), and located behind said respective second end, relative to the direction of rotation of said drill;

said third region including means for cutting said bore in a radial direction including a plurality of side cutting edges (8) generally extending in the direction of, and at an angle relative to, said longitudinal axis, each of said side cutting edges (8) having one end which intersects a respective second end of a corresponding cutting edge 6, and an opposite end, each of said cutting edges (8) being located behind a respective of said roughing edges (7), relative to the direction of rotation of said drill, and a plurality of support surfaces (8*a*) each of which is located radially inwards relative to a respective side cutting edge (8) and behind said respective side cutting edge (8), relative to the direction of rotation of said drill; and, said second region including means for cutting said bore in a second opposite axial direction including a plurality of rearward cutting edges (9), each of said rearward cutting edges (9) extending between said shank and the periphery of said bore crown.

2. The installation drill of claim 1 wherein said rearward cutting edges extend from said opposite end of a respective of said side cutting edges (8) inwards and across said shank.

3. The installation drill of claim 1 wherein said plurality of roughing edges (7) includes two roughing edges located diametrically opposite to each other, each having a corresponding cutting edge (6), said plurality of said cutting edges (8) includes two side cutting edges each having a corresponding cutting edge (6) and a corresponding roughing edge (7), said plurality of support surfaces (8*a*) includes two support surfaces each having a corresponding side cutting edge (8), and said plurality of rearward cutting edges (9) includes two rearward cutting edges.

* * * * *